US005715913A

United States Patent [19]

De Jong

[11] Patent Number: 5,715,913

[45] Date of Patent: Feb. 10, 1998

[54] DOOR SILL FOR AN ELEVATOR CAR

[75] Inventor: Johannes De Jong, Järvenpää, Finland

[73] Assignee: Kone Oy, Helsinki, Finland

[21] Appl. No.: 545,925

[22] Filed: Oct. 20, 1995

[30] Foreign Application Priority Data

Oct. 21, 1994 [FI] Finland ..... 944979

[51] Int. Cl.[6] ..... B66B 13/06

[52] U.S. Cl. ..... 187/334

[58] Field of Search ..... 187/313, 334, 187/333; 49/116, 120

[56] References Cited

U.S. PATENT DOCUMENTS

| | | | |
|---|---|---|---|
| 3,426,480 | 2/1969 | Dzamba | 187/334 |
| 4,781,270 | 11/1988 | Holland | 187/56 |

FOREIGN PATENT DOCUMENTS

| | | |
|---|---|---|
| 94095612 | 9/1994 | Germany . |
| 9495612 | 9/1994 | Germany . |
| 3232683 | 7/1990 | Japan . |
| 3232683 | 10/1991 | Japan . |
| 2012845 | 8/1979 | United Kingdom . |

*Primary Examiner*—Kenneth Noland

*Attorney, Agent, or Firm*—Birch, Stewart, Kolasch & Birch, LLP

[57] ABSTRACT

Sill system for an elevator car, comprising a sill profile (5), a lower door guide (7) movable in a slot (12) in the sill profile (5) and a guide holding bracket (9) for connecting the lower door guide (7) to the door. The guide holding bracket (9) is passed to the lower door guide (7) from below the surface level of the car floor (3).

21 Claims, 2 Drawing Sheets

DOOR SILL FOR AN ELEVATOR CAR

The present invention relates to a door sill system for an elevator.

DESCRIPTION OF THE BACKGROUND ART

It is known that the car sill of the door of an elevator car is located on the top surface of the car floor next to the decorative surface, with the guide slot turned upwards. Door operation is often impeded by litter that has gathered in the sill. The litter is supposed to fall down through holes provided in the car sill into the elevator shaft, from where it is periodically removed. Large items of litter may stick to the sill, impeding the movement of the car doors, and this may result in the elevator being immobilized. Litter may also get between the landing doors below, causing operational disturbances or noise. Disturbing noise is also generated when the car is travelling downwards as air is forced through the litter holes. Especially in the case of fast elevators, this may generate a whistling or turbulence-type noise. Besides, other kinds of noise originating in the elevator shaft can penetrate into the elevator car through these holes. In addition, the car sill is structurally inelegant, and architects in particular have been displeased with the sills because these are esthetically unsuitable for use with surface materials and other solutions selected by architects for the elevator car. If a soft car insulation material is used and the car is suspended in the safety gear frame, which is a very common construction, then there is the risk that the sill base of the car may come out of the sill recess. This is an extremely dangerous situation especially during downward travel as the door of the elevator car may crash into a landing sill, which may even involve a mortal danger to the passengers. To eliminate the drawbacks described above, a new invention is presented.

SUMMARY OF THE INVENTION

The object of the present invention is to eliminate the above-mentioned drawbacks. The car sill of an elevator as provided by the invention comprising a sill profile, a lower door guide movable in a slot in the sill profile and a guide holding bracket for connecting the lower door guide to the door of the elevator car. The sill profile is located below a floor surface of the elevator car and is out of sight from above. The guide holding bracket extends to the lower door guide below the floor surface.

The advantages achieved by the invention include the following:

- the danger and inconvenience caused by litter are reduced and reliability of the door is improved
- the appearance of the elevator car is improved as the use of different floor materials is made easier
- if the doors are mounted in the safety gear frame, then it is possible to use soft rubbers and the new sill fully eliminates the above-mentioned risk of the sill coming off from its recess
- car sills can be made of cheaper materials because the car sill is not exposed to view
- the door works more reliably and landing door disturbances disappear
- noise can be more easily eliminated
- architects will be pleased because the car sill is placed below the decorative surface and need not be considered at all
- architects now have full freedom to design the decorative surface.

BRIEF DESCRIPTION OF THE DRAWINGS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

In the following, the invention is described by the aid an example by referring to the attached drawings, in which.

DETAILED DESCRIPTION OF THE PREFERRED EMBODIMENTS

Figure 1:
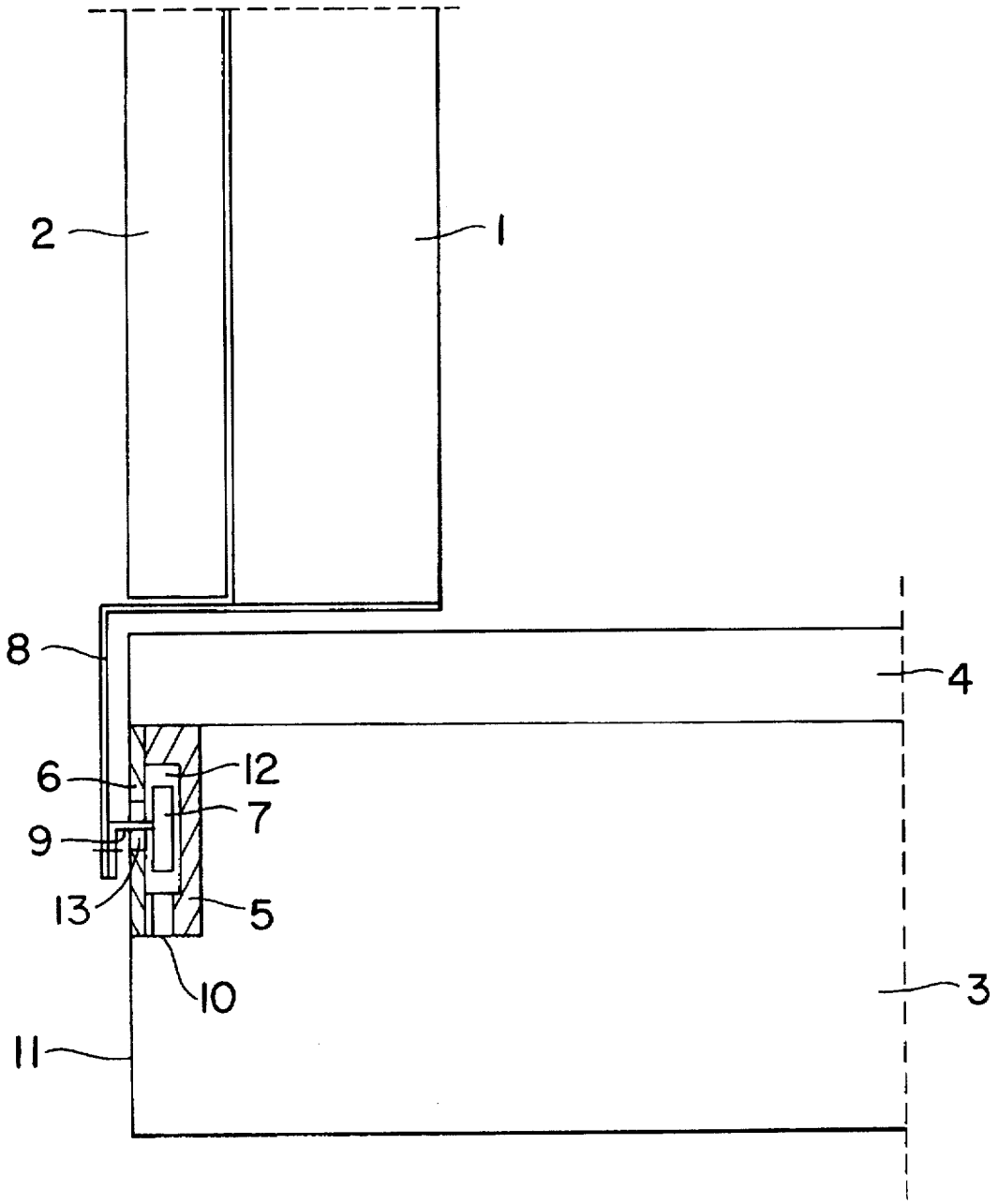
FIG. 1 presents the sill system of the invention.

FIG. 1 shows a car sill 11 as provided by the invention, a car door and a safety edge 2 in an elevator car. The floor of the elevator car is marked with number 3 and it lies below the decorative surface 4. 'Decorative surface' 4 means the surface material topmost on the floor 3 of the elevator car, which may consist of various materials, depending on the situation. The car sill 11 of the invention comprises a cover plate 6 placed on top of the sill 11 to protect it from litter dropped from above. The cover plate 6 also keeps the lower door guide 7 in its guide track. The car sill 11 further comprises a hold plate 9, one end of which is attached to the bottom edge 8 of the car door 1 and the other end to the lower door guide 7. The lower door guide 7 guides the bottom edge of the car door so that it moves along the rail. The car sill profile 5 is located on the side facing towards the floor 3 of the elevator car. The litter hole 10 is located below the lower door guide 7. Litter can fall down into a space inside the car floor 3, from where it is periodically removed. In the solution depicted in FIG. 1, the car sill 11 is placed under the floor surface 4 so that it remains out of sight. The car sill 11 is laid in the same direction with the direction of opening of the doors, so that the cover plate 6 lies in the same plane with the floor edge 11 on the side under the door. The sill slot 12 is large enough to allow vertical movement of the lower door guide 7 when the soft rubber insulation below the car is compressed. The aperture 13 in the cover plate 6 permits the same vertical movement but still prevents the lower door guide 7 from coming out of the slot 12. The bottom edge 8 of the car door may extend farther down than in FIG. 1, e.g. so that it covers the floor edge 11 under the door. This prevents litter from getting into the door sill when the door is closed. Because of the door coupler rollers, part of the bottom edge of the lower door guide 7 can be left out in the region of roller travel. This allows the use of sill clearances of the same size as before with the old sill. In the case of a two-panel side-opening door or a four-panel center-opening door, two sills or two slots are needed, and in the case of a three-panel side-opening door, three sills or three slots are needed.

Figure 2A:
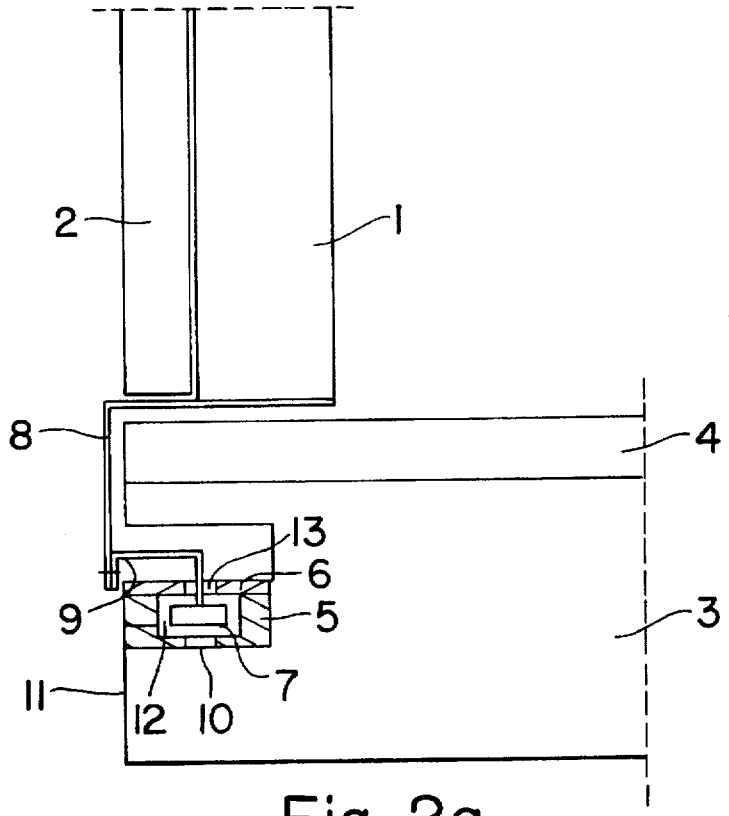
FIG. 2*a* and 2*b* present alternative solutions.
Figure 2B:
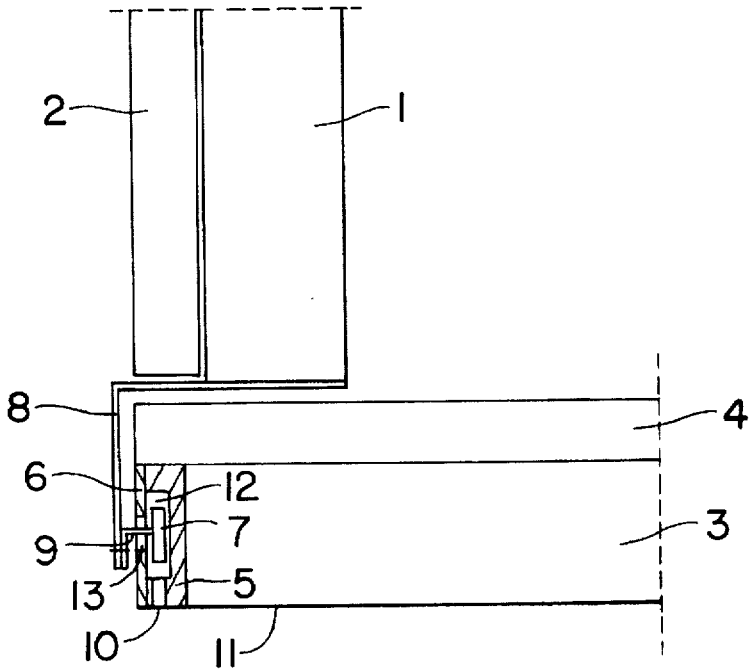

FIGS. 2*a* and 2*b* present two other embodiments. In FIG. 2*a*, the guide rail profile 5 is so placed on the floor surface that the lower door guide 7 lies horizontally. In the floor surface 3, a recess is made to accommodate this guide rail profile 5. In FIG. 2*b*, the guide rail profile 5 is so placed that it extends down to the bottom edge of the floor surface 3. This provides the advantage that litter will fall directly into the shaft.

It is obvious to a person skilled in the art that the embodiments of the invention are not restricted to the examples described above, but that they may instead be varied in the scope of the following claims. The car sill 11 can be placed in different locations in the car floor 3, e.g. in a recess made for the car sill, in different positions, and also below the car floor 3. The car sill 11 can also be placed in the lower part of the car floor 3 so that litter can fall directly into the shaft. In any case, the sill must be placed below the decorative surface 4.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A sill system for an elevator car, comprising:

a sill profile;

a lower door guide movable in a slot in the sill profile;

a guide holding bracket for connecting the lower door guide to a door of the elevator car, the sill profile being located below a floor surface of the elevator car and being out of sight from above, the guide holding bracket extending to the lower door guide below the floor surface; and a cover plate, the slot for the lower door guide being covered with the cover plate.

2. The sill system according to claim 1, wherein the cover plate includes an aperture.

3. The sill system according to claim 2, wherein the slot for the lower door guide permits some vertical movement of the lower door guide.

4. The sill system according to claim 3, wherein a lower edge of the door covers at least one of the slot and the aperture.

5. The sill system according to claim 1, wherein the slot is in a side of the sill profile.

6. The sill system according to claim 5, wherein the sill profile is adjacent to and beneath the floor surface of the elevator car and is spaced from a bottom of the car floor.

7. The sill system according to claim 5, wherein the sill profile is adjacent to and beneath the floor surface of the elevator car and extends to a bottom of the car floor.

8. The sill system according to claim 5, wherein sill profile and the lower door guide are upright and extend in a direction which is generally perpendicular to the floor surface of the elevator car.

9. The sill system according to claim 1, wherein the slot is in a top of the sill profile facing the floor surface of the elevator car.

10. The sill system according to claim 1, further comprising a litter hole provided in the sill profile below the lower door guide.

11. A sill system for an elevator car, comprising:

a sill profile;

a lower door guide movable in a slot in the sill profile, the slot being in a side of the sill profile; and a guide holding bracket for connecting the lower door guide to a door of the elevator car, the sill profile being located below a floor surface of the elevator car and being out of sight from above, the guide holding bracket extending to the lower door guide below the floor surface.

12. The sill system according to claim 11, wherein the sill profile is adjacent to and beneath the floor surface of the elevator car and is spaced from a bottom of the car floor.

13. The sill system according to claim 11, wherein the sill profile is adjacent to and beneath the floor surface of the elevator car and extends to a bottom of the car floor.

14. The sill system according to claim 11, wherein sill profile and the lower door guide are upright and extend in a direction which is generally perpendicular to the floor surface of the elevator car.

15. The sill system according to claim 11, wherein the slot for the lower door guide permits some vertical movement of the lower door guide.

16. The sill system according to claim 15, wherein a lower edge of the door covers at least one of the slot and the aperture.

17. The sill system according to claim 11, further comprising a litter hole provided in the sill profile below the lower door guide.

18. A sill system for an elevator car, comprising:

a sill profile;

a lower door guide movable in a slot in the sill profile; and a guide holding bracket for connecting the lower door guide to a door of the elevator car, the sill profile being located below a floor surface of the elevator car and being out of sight from above, the guide holding bracket extending to the lower door guide below the floor surface, the slot being in a top of the sill profile and facing the floor surface of the elevator car.

19. The sill system according to claim 18, further comprising a cover plate, the slot for the lower door guide being covered with the cover plate and the cover plate having an aperture.

20. The sill system according to claim 19, wherein the slot for the lower door guide permits some vertical movement of the lower door guide.

21. The sill system according to claim 20, wherein a lower edge of the door covers at least one of the slot and the aperture.

* * * * *